US005642938A

United States Patent [19]

Nakagawa et al.

[11] Patent Number: 5,642,938

[45] Date of Patent: Jul. 1, 1997

[54] MIXING APPARATUS FOR MIXING LIQUID CONTAINED IN VESSEL

[75] Inventors: Masayuki Nakagawa, Kako-gun; Hisaaki Inoue, Himeji, both of Japan

[73] Assignee: TOA Medical Electronics Co., Ltd., Hyogo, Japan

[21] Appl. No.: 646,034

[22] Filed: May 7, 1996

[30] Foreign Application Priority Data

May 9, 1995 [JP] Japan ..... 7-110965

[51] Int. Cl.[6] ..... B01F 11/00

[52] U.S. Cl. ..... 366/110; 366/128; 366/209

[58] Field of Search ..... 366/108, 110–112, 366/128, 208–211, 213–216, 218, 219

[56] References Cited

U.S. PATENT DOCUMENTS

| | | | |
|---|---|---|---|
| 3,061,280 | 10/1962 | Kraft et al. | 366/110 |
| 3,159,384 | 12/1964 | Davis | 366/112 X |
| 4,555,183 | 11/1985 | Thomas | 366/208 |
| 4,834,548 | 5/1989 | Tempel et al. | 366/208 |
| 4,943,164 | 7/1990 | Ohishi et al. | 366/110 X |
| 5,431,201 | 7/1995 | Torchia et al. | 366/211 X |
| 5,466,065 | 11/1995 | Catrombon | 366/209 |

FOREIGN PATENT DOCUMENTS 59069 7/1989 Japan .

*Primary Examiner*—Charles E. Cooley

[57] ABSTRACT

A mixing apparatus, which can prevent possibility of mixing nonuniformity and contamination, employs a small and simple mechanism, and is advantageous with respect to costs. A vessel is gripped and held from the right and left sides by a hand member. The hand member horizontally rotatable by an urging power of a coil spring at the bottom of a support member. A vibration motor comprises a DC coreless motor body and an eccentric weight, the weight being eccentrically mounted to a motor shaft of the motor body. The rotation of the weight allows the motor body to eccentrically rotate, whereby the support member conically revolves and vibrates. The weight has a semicircular cross section. The support member is connected to a mobile member for moving the support member through a resilient member to allow the conical revolution of the support member.

10 Claims, 4 Drawing Sheets

MOBILE MEMBER 26
RESILIENT MEMBER 42
18
16 SUPPORT MEMBER
LINKING MEMBER 28
36
32
40
34
30
38
44

MIXING APPARATUS FOR MIXING LIQUID CONTAINED IN VESSEL

BACKGROUND OF THE INVENTION

1. Field of the Invention

The present invention relates to a mixing apparatus for mixing a liquid in a vessel. More particularly, it relates to a mixing apparatus utilized for well mixing of a liquid sample and a liquid reagent contained in a vessel in an automatic analyzer.

2. Description of the Related Arts

Conventionally, an automatic analyzer, such as a blood coagulation measuring apparatus for measuring the coagulability of blood, involves mixing of a subject liquid sample (plasma) and a liquid reagent in a vessel.

Known apparatus for mixing a liquid in a vessel are, for example, one which allows the liquid to be discharged into the vessel and makes use of the discharging pressure for mixing (Apparatus A), one which allows a bar-like member to be inserted into the vessel containing the liquid and utilizes the bar-like member for mixing (Apparatus B), and one which allows an eccentric rotational movement of the vessel containing the liquid for mixing (Apparatus C) as disclosed in Japanese Examined Utility Model Publication No. Hei. 5(1993)-9069.

Apparatus A is liable to cause mixing nonuniformity because it utilizes discharging pressure. Apparatus B necessitates washing of the bar-like member every time the mixing is conducted and, moreover, when the washing is insufficient, it may possibly cause mutual contamination of liquids. Apparatus C has a drawback that it tends to be large and mechanically complicated. Moreover, there is a problem of control that the driving source such as the motor must be stopped at a predetermined position to place the vessel at a prescribed location after the mixing.

SUMMARY OF THE INVENTION

The present invention has been made in view of the above circumstances, and the purpose thereof is to provide a mixing apparatus which can prevent the possibility of generating mixing nonuniformity or contamination, employs a small and simple mechanism, and is advantageous with respect to costs.

Accordingly, the present invention provides a mixing apparatus comprising: a hand member for holding a vessel for containing a liquid to be mixed; a support member for supporting the hand member; a mobile member which moves in a predetermined region; a vibration motor mounted to the support member; and a linking member for linking the support member to the mobile member so that the support member is conically revolvable with respect to the mobile member when the vibration motor is driven, thereby enabling conical revolution movement of the vessel held by the hand member.

DETAILED DESCRIPTION OF THE PREFERRED EMBODIMENTS

Figure 1:
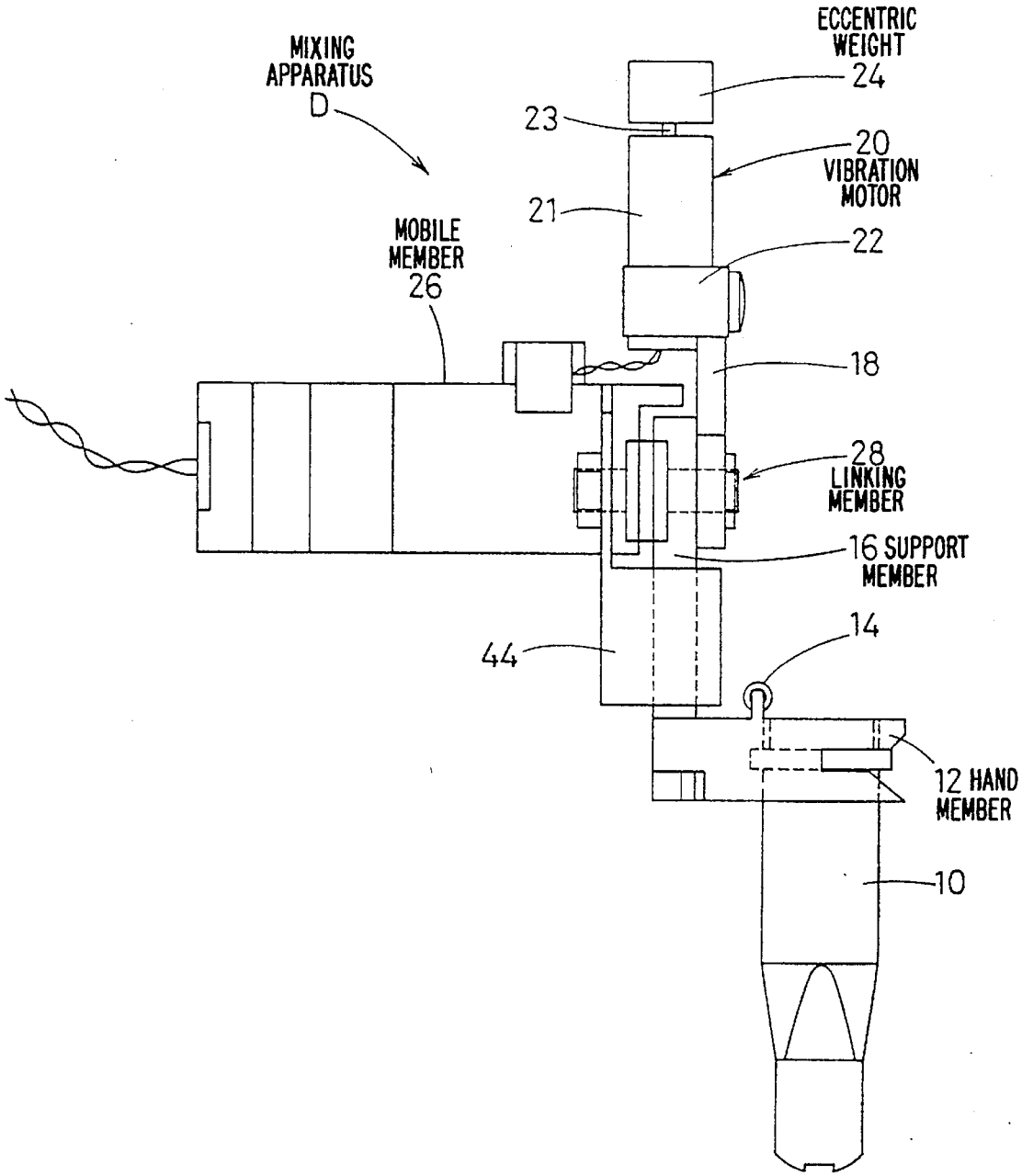
FIG. 1 is a side view of a mixing apparatus according to one embodiment of the present invention.

Vessels having various sizes, shapes, and materials are selectively used for containing a liquid to be mixed. An example of such vessel is known as a cuvette, made of plastic or glass, which can contain 50 to 300 μl of a liquid, such as a sample or a reagent, to be measured.

A hand member is constructed to hold or release an upper, a middle or the like portion of the vessel located at a prescribed position of a rack, a turntable or the like, depending on the needs. The hand member to be used, for example, comprises a pair of right and left board-like members and a coil spring stretched over the end portions of the board-like members in such a manner that the pair of board-like members are pivoted at each of the base end portions to be horizontally rotatable by an urging power of the coil spring.

Holding portions of these board-like members have a suitable shape and structure in accordance with an external shape, a material or the like of the vessel to be held. For example, if the vessel has a cylindrical shape, the holding portions of the board-like members have a recessed portion in accordance with the cylindrical shape of the vessel to hold the vessel firmly in the recessed portion, or are formed of a resilient material.

The method for holding a vessel by the hand member employs gripping and holding, in a sandwich-like configuration, of an external upper surface of the vessel in a state in which the liquid may not spill out of the vessel when a mixing apparatus is in operation, for example, in a state in which the vessel is substantially vertical.

Generally, the hand member is constructed to hold one vessel. Alternatively, however, the hand member may be constructed to hold a plurality of vessels in a row in accordance with the needs. By using such a hand member, it is possible to mix liquids in a plurality of vessels simultaneously.

The holding and releasing of the hand member are actuated by, for example, a forward and backward movement of the hand member based on the horizontal back and forth movement of a mobile member linked to the hand member via a support member and a linking member.

The support member supports the hand member. If the hand member comprises the above-mentioned board-like members and the coil spring, the support member may be, for example, a vertical board-like member supporting the base end portion of each of the board-like members for pivoting movement.

The mobile member is linked to the support member via the linking member and moves in a predetermined region. The predetermined region herein referred to represents a determined region of movement selected from a linear region (one-dimensional region), a planar region (two-dimensional region), a spatial region (three-dimensional region), A vibration motor is mounted to the support member and generates an eccentric rotational movement. An example of the vibration motor to be used is a small-sized DC coreless motor. Preferably, a rotation speed of the vibration motor is adjusted to be in the range of, for example, 5000 to 10000 rpm. More preferably, the rotation speed is in the range of, for example, 7000 to 8000 rpm.

The linking member links the support member and the mobile member into a semi-fixed state. The linking connection is adapted in such a manner that the support member is capable of conical revolution movement with respect to the mobile member when the vibration motor is driven. The conical revolution movement herein referred to represents a movement wherein, when the support member revolves with respect to a point serving as a fulcrum, the support member describes a trajectory of a conical shape with its apex at the above-mentioned fulcrum and with its base having a circular shape. This movement of the support member enables the vessel held by the hand member to eccentrically revolve to rotate and mix the liquid in the vessel. The radius and the speed of this revolution movement are determined by the eccentricity and the rotation speed of the vibration motor, the position of the above fulcrum, and others.

If one wishes to attach importance to obtaining a mixing apparatus which employs a small and simple mechanism and is advantageous with respect to costs, it is more preferable that the hand member is mounted on one side of the support member and the vibration motor is mounted on the other side of the support member. In such a case, the support member revolves with a fulcrum at the linking portion linking the support member to the mobile member.

In order that the above revolution movement is well generated in a simple construction, it is preferable that the linking member comprises a resilient member and that the support member is linked to the mobile member via the resilient member. In other words, the resilient member transmits and amplifies the eccentric rotational movement of the vibration motor and changes the movement into a conical revolution movement of the support member. As the resilient member, a urethane rubber, a foamed sponge, or a coil spring may be preferably used. The Shore hardness (JIS) of the urethane rubber to be used is preferably in the range of 20 to 50 degrees, more preferably in the range of 30 to 40 degrees when a liquid of about 50 to 300 μl is to be mixed.

In view of generating the above revolution movement more effectively and smoothly, the vibration motor preferably comprises a motor body and a weight, the weight being eccentrically mounted to the motor shaft of the motor body and having a cross section of a generally semicircular shape.

The present invention will be hereinafter detailed, in conjunction with the attached drawings, by way of an embodiment thereof, which is not to be construed as being intended to limit the scope of the present invention.

Figure 2:
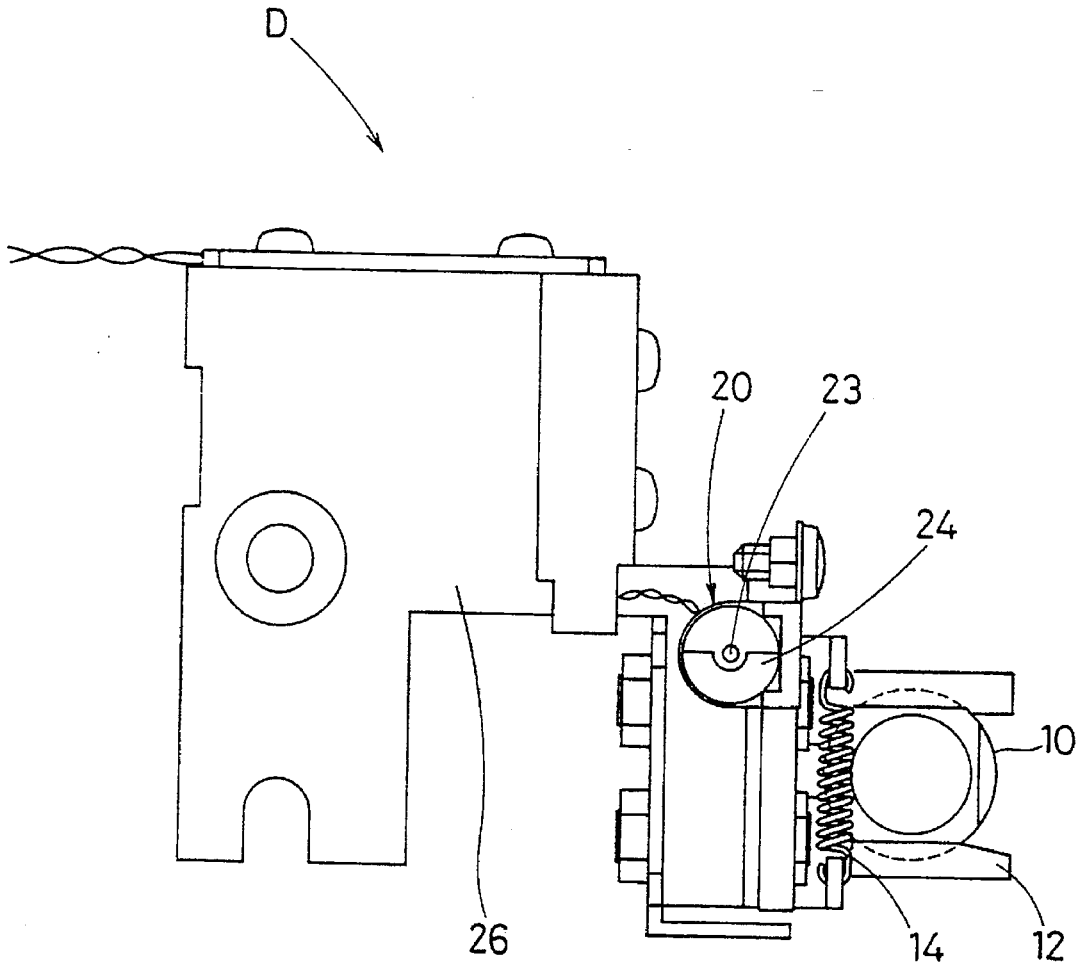
FIG. 2 is a plan view of the mixing apparatus in FIG. 1.
Figure 3:
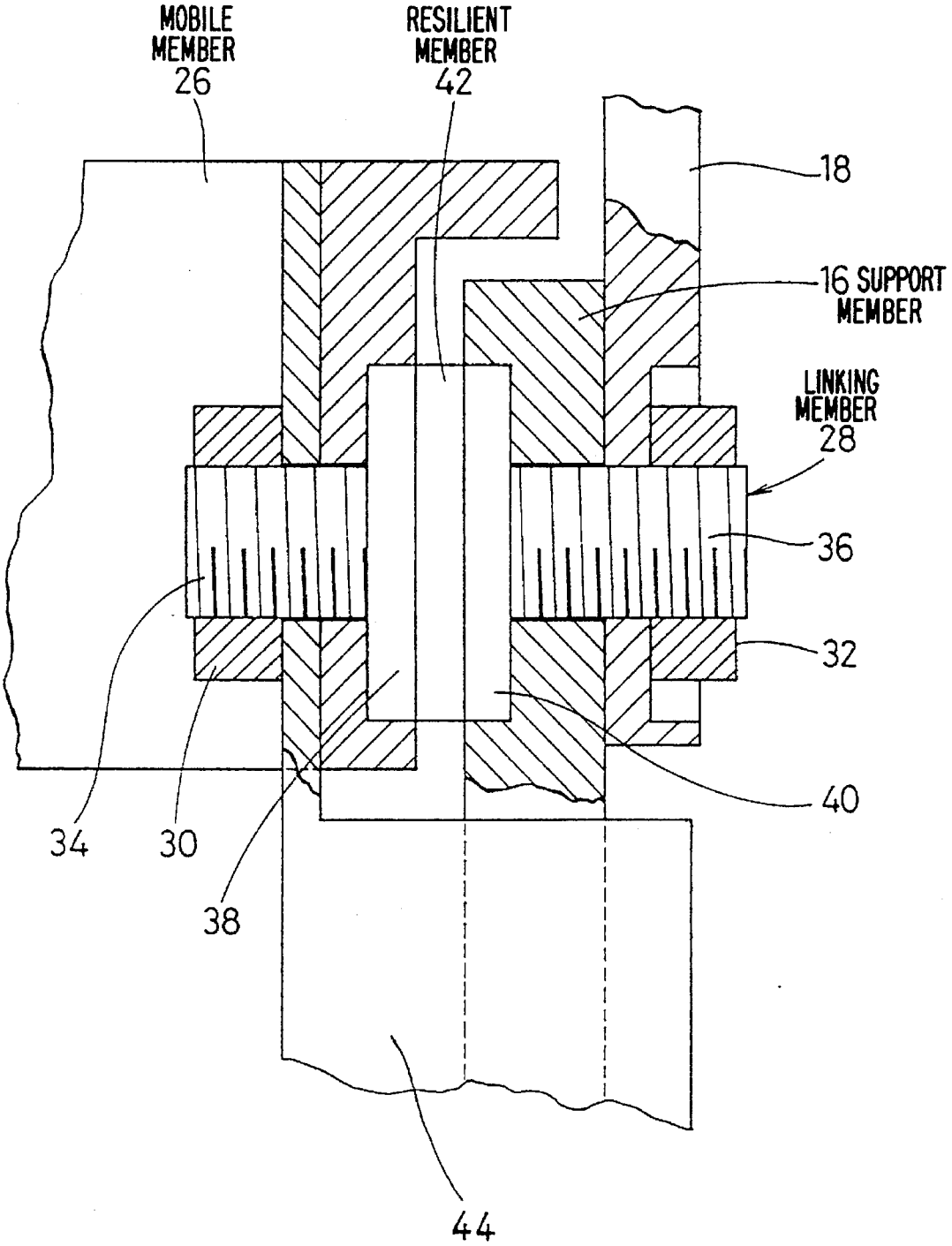
FIG. 3 is an enlarged side sectional view of a part (around a linking member) of the mixing apparatus in FIG. 1.
Figure 4:
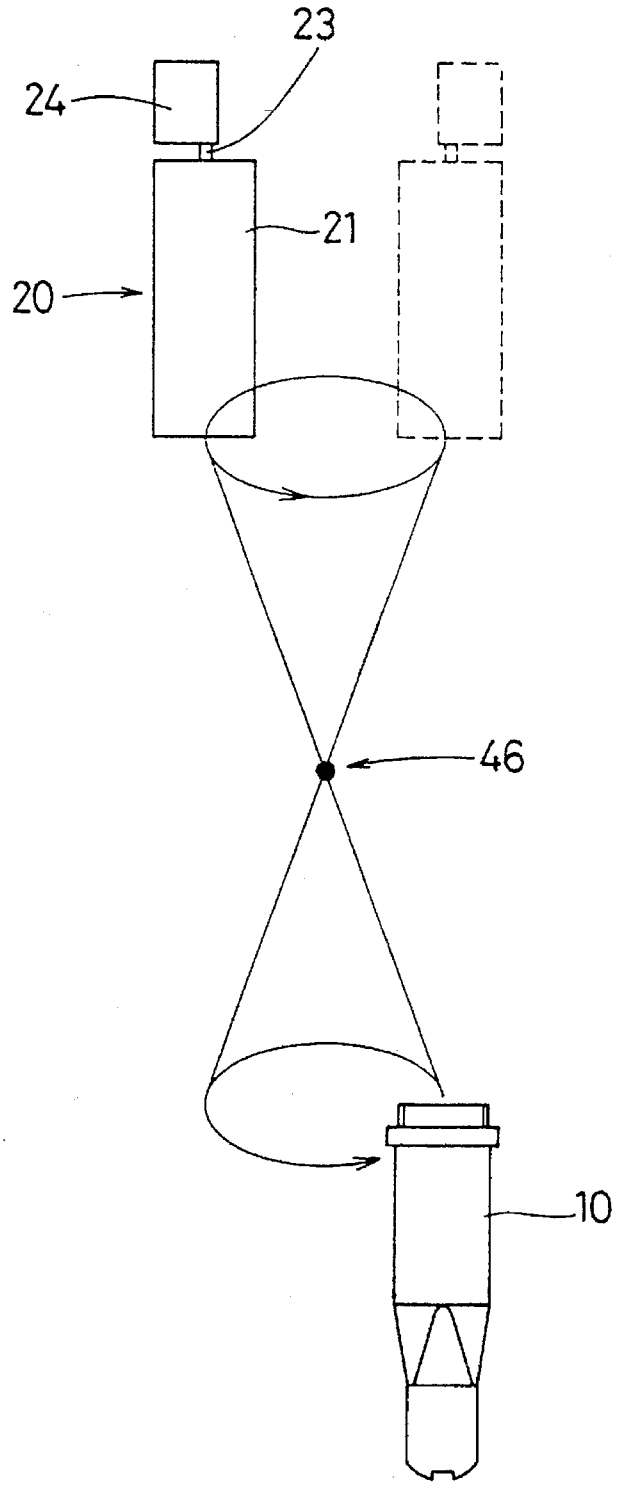
FIG. 4 is an explanatory view for explaining the mixing operation of the mixing apparatus in FIG. 1.

FIG. 1 to FIG. 4 are views showing a mixing apparatus D according to an embodiment of the present invention. FIG. 1 is a side view of the mixing apparatus D. FIG. 2 is a plan view of the mixing apparatus D. FIG. 3 is an enlarged side sectional view of a part (around a linking member) of the mixing apparatus D. FIG. 4 is an explanatory view for explaining the mixing operation of the mixing apparatus D.

In FIGS. 1 and 2, the reference numeral 10 represents a vessel made of plastic for containing and holding a subject liquid sample and a liquid reagent and for generating a prescribed reaction by mixing of the sample with the reagent. The vessel 10 is transparent if the change in optical characteristics (scattered light intensity) of the mixed solution is to be measured.

The vessel 10 is gripped and held from the right and left sides by a hand member 12. The hand member 12 comprises a pair of horizontally disposed right and left board-like members and a coil spring 14 stretched over the base end portions of the board-like members. The hand member 12 is constructed in such a manner that the pair of board-like members are pivoted at each of the base end portions to be horizontally revolvable by an urging power of the coil spring 14 at the bottom of a vertically disposed rectangular board-like support member 16.

The reference numeral 20 represents a vibration motor, which is integrally mounted to the support member 16 by upper and lower board-like mounting members 18 and 22 at the top of the support member 16. The vibration motor 20 comprises a DC coreless motor body 21 and an eccentric weight 24, the weight 24 being eccentrically mounted to a motor shaft 23 of the motor body 21. The rotation of the weight 24 allows the motor body 21 to conically revolve and vibrate. In order to increase the amplitude of the conical revolution vibration, the weight 24 preferably has a large moment with respect to the motor shaft 23. In view of this, the weight 24 is adapted to have a semicircular cross section (the shape of a circular cylinder longitudinally halved along the motor shaft 23).

The reference numeral 26 represents a mobile member which moves in a prescribed region by a mechanism not shown. The mobile member 26 moves in three-dimensional directions (in X, Y, and Z axis directions). The mechanism therefor can be provided by a known art.

The mobile member 26 and the support member 16 are linked by a linking member 28. However, they are not completely fixed but are linked in a semi-fixed state. The semi-fixed state herein referred to represents a state in which the support member 16 is linked to the mobile member 26 with some three-dimensional degree of freedom.

Referring to FIG. 3, the periphery (the linking portion) of the linking member 28 will be hereinafter explained. The mobile member 26 and the support member 16 are linked by screwing the linking member 28 with nut members 30 and 32. The reference numeral 44 represents a protection cover. The linking member 28 comprises a resilient member 42, via which the mobile member 26 is linked to the support member 16. More specifically, the linking member 28 is constructed by contacting and linking a first member 34 and a second member 36 with each other by using the resilient member 42, the first and second members 34 and 36 being made of metal and having flange portions 38 and 40, respectively.

In other words, the linking is such that the mobile member 26 contacts with the flange portion 38 on one side, the support member 16 contacts with the flange portion 40 on the other side, and there is a gap between the mobile member 26 and the support member 16.

Here, the resilient member 42 has a disk-like shape with a diameter of 7 mm and a thickness of 1 mm and, specifically, is made of an ether type polyurethane ("Sorbothane" manufactured by Sanshin Enterprises Co., Ltd. in Japan) having a hardness in the range of 30 to 50 when measured by a Shore (OO scale) hardness meter.

The linking member 28 has only to link the support member 16 to the mobile member 26 so that the support member 16 is conically revolvable with the linking member serving as a fulcrum. The same operational effect can be obtained by providing a male screw member and an O-ring and by linking the members 26 and 16 using a nut member via the O-ring.

The support member 16 has only to be loosely linked to the mobile member 26. The linking between the support member 16 and the mobile member 26 may be constructed as follows in order to generate the conical revolution movement. The linking member 28 is formed with a bar-like member having a screw portion and with a resilient member (for example, an O-ring or a coil spring) penetrating through the bar-like member. The mobile member 26 and the support member 16 respectively contact with the resilient member, and there is a gap between the mobile member 26 and the support member 16. Alternatively, the linking member 28 may be constructed by providing a ball member between the first and second members.

By thus linking the mobile member 26 to the support member 16, the support member 16 revolves conically with the linking portion serving as a fulcrum 46 by the rotation of the vibration motor 20, as shown in FIG. 4. In accordance with this movement, the liquid (sample + reagent) contained in the vessel 10 conically revolves to be suitably mixed.

FIGS. 1 to 4 show a construction in which, in view of facility in construction and others, the vibration motor 20 is disposed on one side of the support member 16, the hand member 12 is disposed on the other side, and the linking member 28 (the fulcrum 46) is disposed therebetween. Alternatively, however, the vibration motor 20 may be provided on the side of the hand member 12.

Next, an overall operation of the mixing apparatus D will be briefly explained. First, by a movement of the mobile member 26, the hand member 12 proceeds toward an empty vessel 10 to grip and hold the empty vessel 10 at a predetermined position by pressing.

Then, the hand member 12 rises and moves to a different position so that a sample of 50 to 100 μl is dispensed into the vessel 10. The hand member 12 further moves to a different position so that a reagent of 50 to 200 μl is dispensed into the vessel 10.

After the reagent is dispensed, the liquid is immediately mixed for a prescribed amount of time (for example, 0.6 seconds) by the driven motion of the vibration motor 20. The rotation speed of the vibration motor 20 for mixing may be any amount of time, for examples 7500±500 rpm. After mixing, the hand member 12 moves to a measuring portion to release the vessel 10, whereby the optical characteristics of the mixed liquid in the vessel 10 are measured. After the measurement, the vessel 10 is discarded.

The mixing apparatus D is constructed in such a manner that the vibration motor 20 is disposed on one side of the support member 16, the hand member 12 is disposed on the other side, and the linking member 28 (the fulcrum 46) is disposed therebetween, whereby the support member 16 conically revolves by the driven motion of the vibration motor 20 with the linking portion serving as the fulcrum Also, the vibration motor 20 comprises the eccentric weight 24, and the linking member 28 comprises the resilient member 42. Accordingly, the liquid (sample + reagent) in the vessel 10 conically revolves to be suitably mixed. Further, when the vibration motor 20 stops, the support member 16 halts at its original location, irrespective of the position at which the motor shaft 23 stops.

Since the mixing apparatus according to the present invention is constructed in such a manner as described above, the mixing apparatus produces the following remarkable effects.

In other words, the mixing apparatus according to the present invention comprises a hand member for holding a vessel for containing a liquid to be mixed, a support member for supporting the hand member, a mobile member which moves in a predetermined region, a vibration motor mounted to the support member, and a linking member for linking the support member to the mobile member so that the support member is conically revolvable with respect to the mobile member when the vibration motor is driven. Accordingly, the eccentric rotational movement of the vibration motor mounted to the support member is converted to the conical revolving movement by the linking member, thereby allowing the hand member to revolve. By this movement, the liquid in the vessel held by the hand member revolves along the inner surface of the vessel to be suitably mixed. This can prevent the possibility of mixing nonuniformity and contamination. Also, the mixing apparatus according to the present invention employs a small and simple mechanism, and is advantageous with respect to costs. Moreover, the mixing apparatus does not particularly need a control mechanism for determining the position of the vessel.

In the mixing apparatus according to the invention, the hand member is disposed on one side of the support member, and the vibration motor is disposed on the other side of the support member, thereby allowing the support member to revolve with a fulcrum at a linking member linking the support member to the mobile member. Therefore, the effect produced by the mixing apparatus according to the present invention can be simply and securely achieved by a mixing apparatus which employs a small and simple mechanism and which is advantageous with respect to costs.

In the mixing apparatus according to the invention, the linking member comprises a resilient member via which the support member is linked to the mobile member. This allows the support member to conically revolve well in such a simple construction. Therefore, the effect produced by the mixing apparatus according to the present invention can be more securely achieved.

In the mixing apparatus according to the invention, the vibration motor comprises a motor body and a weight, the weight being eccentrically mounted to a motor shaft of the motor body and having a semicircular cross section. Therefore, the effect produced by the mixing apparatus according to the present invention can be more effectively and smoothly obtained.

What we claim is:

1. A mixing apparatus for mixing liquid contained in a vessel, comprising:

a support member;

a hand member fixed to the support member, the hand member holding the vessel;

a mobile member which supports the support member;

a vibrating unit mounted on the support member, the vibrating unit vibrating the support member; and a linking member movably disposed between the support member and the mobile member, the linking member linking the support member to the mobile member such that the support member makes conical revolution movement with respect to the mobile member when the vibrating unit is driven, thereby enabling conical revolution movement of the vessel held by the hand member.

2. A mixing apparatus according to claim 1, wherein the hand member is disposed on one side of the support member with respect to the linking member, and the vibrating unit is disposed on the other side of the support member with respect to the linking member, thereby allowing the support member to perform the conical revolution movement with a fulcrum at the linking member.

3. A mixing apparatus according to claim 1, wherein the linking member comprises a resilient member through which the support member is linked to the mobile member.

4. A mixing apparatus according to claim 1, wherein the hand member comprises a pair of horizontally disposed board-like members and a coil spring stretched over end portions of the board-like members such that the pair of the board-like members are pivoted at each of base end portions to be horizontally rotatable by an urging power of the coil spring.

5. A mixing apparatus according to claim 1, wherein the support member has a vertically disposed rectangular board-like shape.

6. A mixing apparatus according to claim 1, wherein the mobile member moves said support member in three-dimensional directions.

7. A mixing apparatus according to claim 1, wherein the vibrating unit includes a motor and a weight for generating the vibration, the weight being eccentrically mounted to a shaft of the motor and having a semicircular cross section.

8. A mixing apparatus according to claim 1, wherein the linking member is constructed by contacting and linking a first member and a second member with each other by intermediation of a resilient member made of polyurethane, the first member being made of a metal and having a flange portion with which the mobile member contacts, and the second member being made of a metal and having a flange portion with which the support member contacts.

9. A mixing apparatus of claim 1, wherein said mobile member selectively moves the support member from a first position to a second position.

10. A mixing apparatus of claim 1, wherein the hand member and the vibrating unit are disposed on a same side with respect to the linking member.

* * * * *